US005867954A

United States Patent [19]

Lin

[11] Patent Number: 5,867,954

[45] Date of Patent: Feb. 9, 1999

[54] MULTI-AXIS PRESTRESSED DOUBLE-TEE BEAM AND METHOD OF CONSTRUCTION

[76] Inventor: Wei-Hwang Lin, Dept. of Military Engr., Chinese Military Academy 830 R.O.C. Feng - Shan, Taiwan

[21] Appl. No.: 929,327

[22] Filed: Sep. 6, 1997

[51] Int. Cl.[6] ..... E04C 3/10

[52] U.S. Cl. ..... 52/223.12; 52/223.8; 52/223.9; 52/223.14; 52/231

[58] Field of Search ..... 52/223.8, 223.13, 52/223.12, 223.9, 223.14, 231, 223.1

[56] References Cited

U.S. PATENT DOCUMENTS

| | | | |
|---|---|---|---|
| 3,733,669 | 5/1973 | Coho | 29/155 R |
| 4,006,523 | 2/1977 | Mauquoy | 29/452 |
| 4,047,341 | 9/1977 | Bernardi | 52/223 R |

*Primary Examiner*—Carl D. Friedman
*Assistant Examiner*—Brian Glessner

[57] ABSTRACT

A multi-axis prestressed double-tee beam and method for construction the same is provided, the prestressed double-tee beam includes a cantilever type and a simple-support type, the cantilever type is composed of a pair of laterally combined steel skeletons and each includes a flat elongate erect web having straight upper edge and a bowed lower edge, a pair of upward sloped upper flanges extended along the length of the web, an elongate groove of U-shaped section centrally extended between the upper flanges, a single lower flange extended along the length of the lower edge of the web, a bottom engageable with the lower end of the combined steel skeletons, a plurality of wedges inserted into the groove and a plurality of triangular reinforcement of different size spacedly secured to the lateral sides of the webs abutting the upper flanges, the simple-support type is mostly similar to the cantilever type except a slightly upward arcuate rectangular cross-section and equal sized triangular reinforcements, besides it forms no elongate groove. Nevertheless, both of them provide multi-axis prestresses.

14 Claims, 9 Drawing Sheets

3—3

3'—3'

X
Y
Z 70
70'
71
71'
72
72'
73
73'
74
74'
81
82
7 — 7
7' — 7'

80
90
91
92
93
94
X
Y
Z

MULTI-AXIS PRESTRESSED DOUBLE-TEE BEAM AND METHOD OF CONSTRUCTION

BACKGROUND OF THE INVENTION

The present invention relates to prestressed beams and more particularly to a novel structure of a multi-axis prestressed double-tee beam and method for construction which includes a cantilever type and a simple-support type and exerts multi-directional prestresses from along a longitudinal, horizontal and vertical orientations.

To construct a bridge is to build up piers of predetermined span at first and then is to prepare the beams which build over the piers therebetween. Finally, the concrete slab is paved on the beams to carry the traffic load. FIG. 1 shows a cantilever beam, at two ends of which the deflection is normally greater than that at middle portion of the beam. FIG. 2 shows a simple-support beam which is contrary to the cantilever beam because the deflection at middle portion of which is greater than that at two ends and the deflection will become more greater upon the increasing of the traffic load. However, if a multi-axis prestressed beam is provided on the bridge, the above deflections will be obviated or offset. Furthermore, the multi-axis prestressed beam is possible to elongate span of the bridge to obtain economical construction of a bridge.

SUMMARY OF THE PRESENT INVENTION

The main object of the present invention is to provide a multi-axis prestresed double-tee beam and method for construction the same which can effectively obviate a bridge from greater deflection or deformation because of the heavy traffic load in order to promote the loading capability of a bridge.

Another object of the present invention is to provide a multi-axis prestressed double-tee beam and method for construction the same which aims to elongate the span of a bridge and broadens the space between the adjacent beams.

Still another object of the present invention is to provide a multi-axis prestressed double-tee beam and method for construction the same which method may be namely steel-shape method performed with novel and specific process which saves time and labor.

Further object of the present invention is to provide a multi-axis prestressed double-tee beam and method for construction the same which includes stretching links to flexibly connected the beams so as to promote the stability and shock-proof capability of the bridge.

Accordingly, the multi-axis prestressed double-tee beam of the present invention comprises two types of steel skeletons such as a cantilever type and a simple-support type, each of the skeletons is composed of a pair of identical steel bodies juxtaposedly and symmetrically connected together and connected at bottom by a longitudinal steel plate and appropriate fastening means. The steel bodies each includes an erect web, a pair of bent upper flanges, a single lower flange and a longitudinal groove centrally extending along the length thereof, a plurality of triangular reinforcements and a plurality of wedge means will be respectively adapted to stuff the groove after that the upper flanges become flat under hydraulic pressures.

The present invention will become more fully understood by reference to the following detailed description thereof when read in conjunction with the attached drawings.

BRIEF DESCRIPTION OF THE DRAWINGS

FIGS. 6 and 6A are the sectional views illustrating in detail of the hydraulic presses applied onto the upper flanges of the steel skeleton of the cantilever type prestressed beam, wherein FIG. 6A is taken from line 6—6 of FIG. 6.

DETAILED DESCRIPTION OF THE PREFERRED EMBODIMENT

Figure 1:
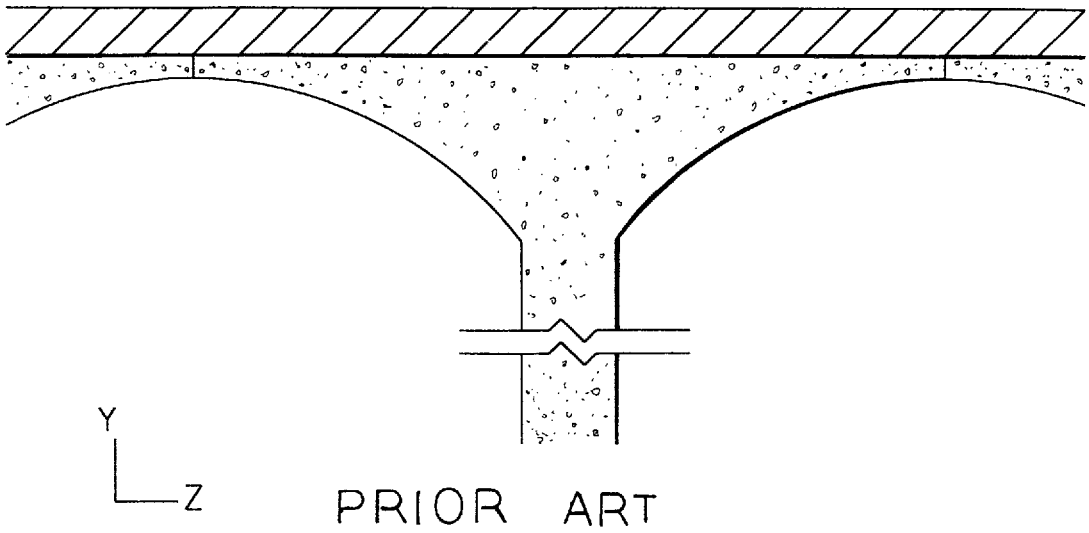
PRIOR ART FIG. 1
FIG. 1 is an elevational view indicating a bridge built up of cantilever type of prestressed beams according to the prior art.
Figure 2:
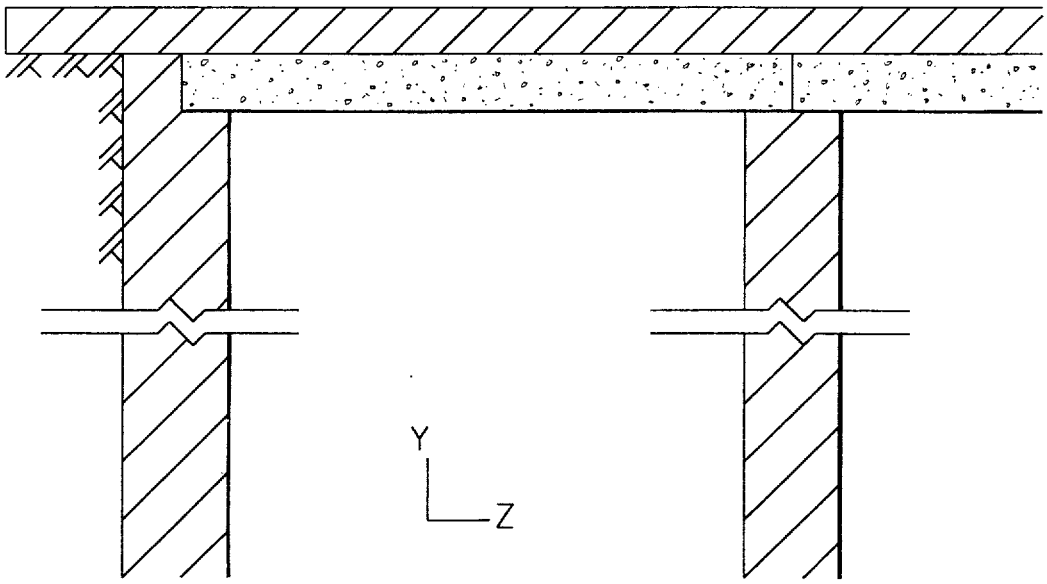
PRIOR ART FIG. 2
FIG. 2 is an elevational view indicating a bridge built up of simple-support type of prestressed beam according to the prior art.
Figures 3, 3A, 3B:
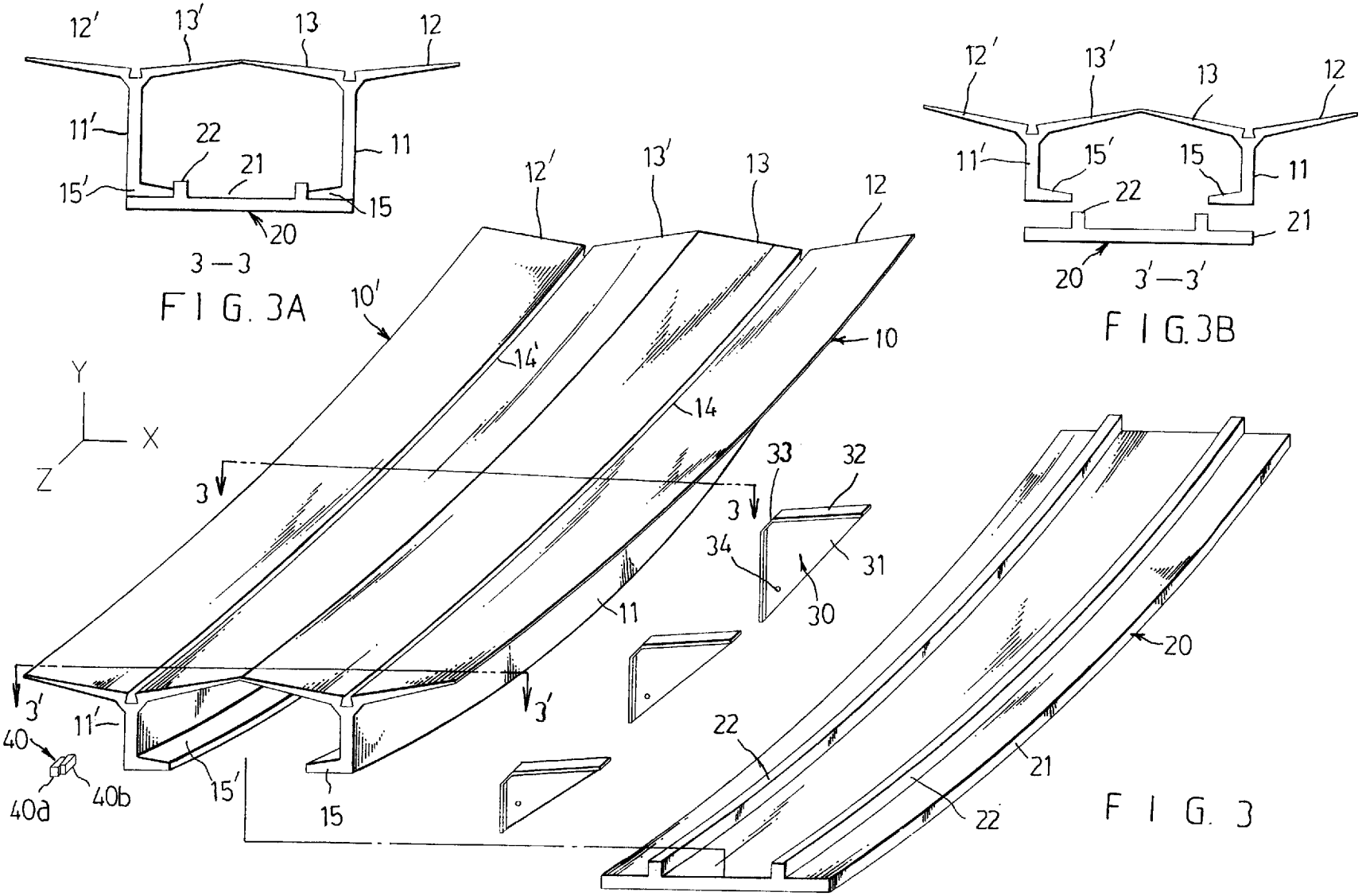
FIG. 3 is an exploded perspective view to show a preferred embodiment of a coupled steel skeleton of a cantilever type prestressed beam according to the present invention.
FIG. 3A and 3B are the sectional views taken from lines 3—3 and 3'—3' of FIG. 3, FIGS. 4 and 4A are the elevational views indicating the operation of the hydraulic presses upon the upper flanges of the steel skeleton of the cantilever type prestressed beam.
Figure 4:
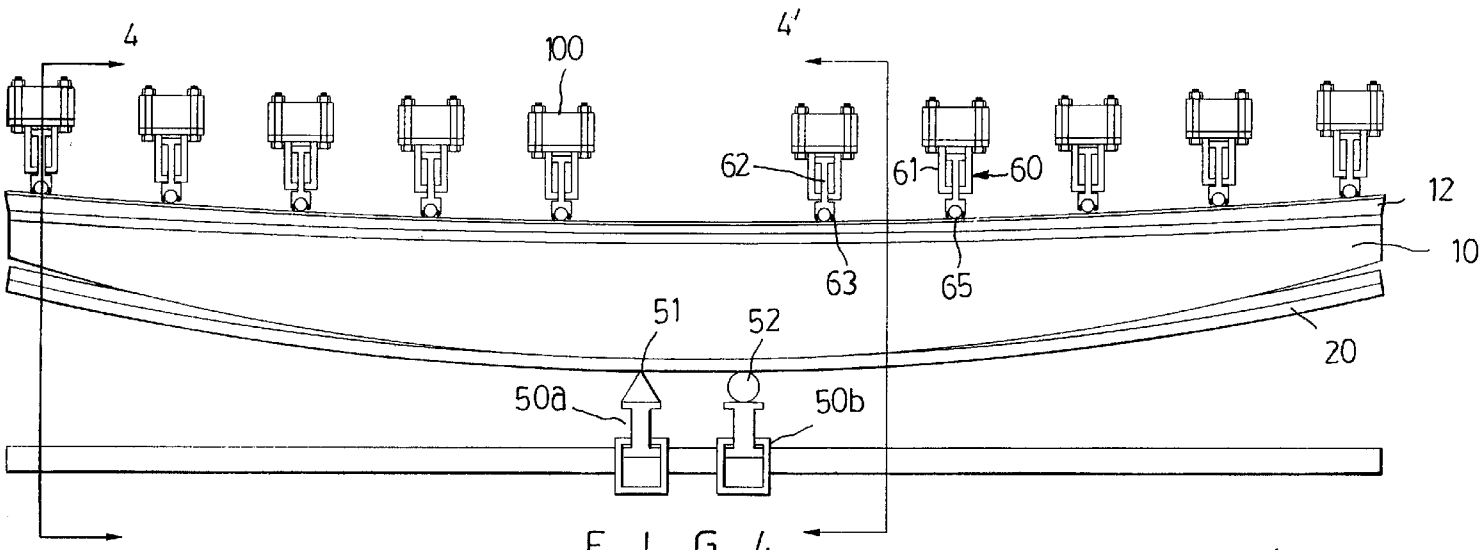

With reference to FIGS. 3, 3A and 3B of the drawings, the cantilever type of the multi-axis prestressed double-tee beam comprises a pair of first and second steel skeletons 10 and 10' of roughly Y-shaped section, a bottom 20, a plurality of triangular reinforcements 30 and a plurality of pairs of wedges 40. The steel skeletons 10 and 10' each includes an erect web 11 and 11' of a roughly bowed cross-section having a straight upper edge and an arcuate lower edge (as shown in FIG. 4), a pair of first and second upward sloped upper flanges 12 and 13 or 12' and 13' laterally and obliquely extended outward from the top of the erect web 11 and 11' at a predetermined inclination relative to the horizontal plane and with the inclination at two ends thereof slightly greater than that at middle portion (as shown in FIGS. 3A and 3B), an elongate groove 14 and 14' of roughly U-shaped section centrally extended in the top of the skeleton 10 and 10' between the sloped upper flanges 12 and 13 or 12' and 13' and along the length thereof for henceforth receiving the wedges 40 on pair by pair basis and a single lower flange 15 and 15' laterally extended inward from the lower end of the erect web 11 and 11' each having a slightly sloped upper surface and a flat underside. The lower flange 15 and 15' is narrower than each of the upper flanges 12 and 13 or 12' and 13' and the steel skeletons 10 and 10' are symmetrically and intergrally connected along the length of their second upper flanges 13 and 13' so that their lower flanges 15 and 15' are facing each other and their upper flanges 12, 13, 13' and 12' form a roughly W-shaped section (as shown in FIGS. 3, 3A and 3B).

The bottom 20 includes an arcuate rectangular steel plate 21 and a pair of longitudinal protrusions 22 parallel extended spaced apart on the upper surface and along the length of the plate 21. The plate 21 has a curvature generally conforming with the bowed lower end of the erect web 11 of the steel skeletons 10 and 10' (as shown in FIG. 4) and a width equals to the distance between the outward lateral surfaces of the erect webs 11 and 11', further the distance between outward lateral surfaces of the pair of the longitudinal protrusions 22 equals to the distance between inward ends of the lower flanges 15 and 15' (as shown in FIG. 3A).

The triangular reinforcement 30 includes a plurality of different sized right-angled triangular steel pieces 31 reinforced on opposite sides with rectangular rib 32 including a frustum part 33 therebetween and a connection hole 34 adjacent a lower angle so that the triangular reinforcements 30 can conform the triangular space between upper flanges 12 and 12' or 13 and 13' and the erect web 11 and 11' after that the flanges 12 and 12' or 13 and 13' become flat.

Referring to FIGS. 4, 4A and 5A to 5D which illustrate the method for construction of the double-tee cantilever prestressed steel beam and the steps set forth as follows:

The first step is horizontally placing the bottom 20 onto a pair of first and second hydraulic supports 50*a* and 50*b* which are previously secured to the base of a working site and support the middle portion of the bottom at the position where the pier or abutment of a bridge will support. The first hydraulic support 50*a* has a tapered upper end which is namely a hinge 51 and the second hydraulic support has a spherical upper end which is namely a roller 52. Further, the elevations of the upper ends of the hydraulic supports 50*a* and 50*b* are adjustable so as to keep the bottom 20 completely horizontal.

The second step is to mount the integrated steel skeleton 10 and 10' onto to bottom 20 and to make sure that the outward lateral surfaces of the pair of the longitudinal protrusions are completely engaged with the inward ends of the lower flanges 15 and 15' (as shown in FIG. 3A).

Figure 5A:
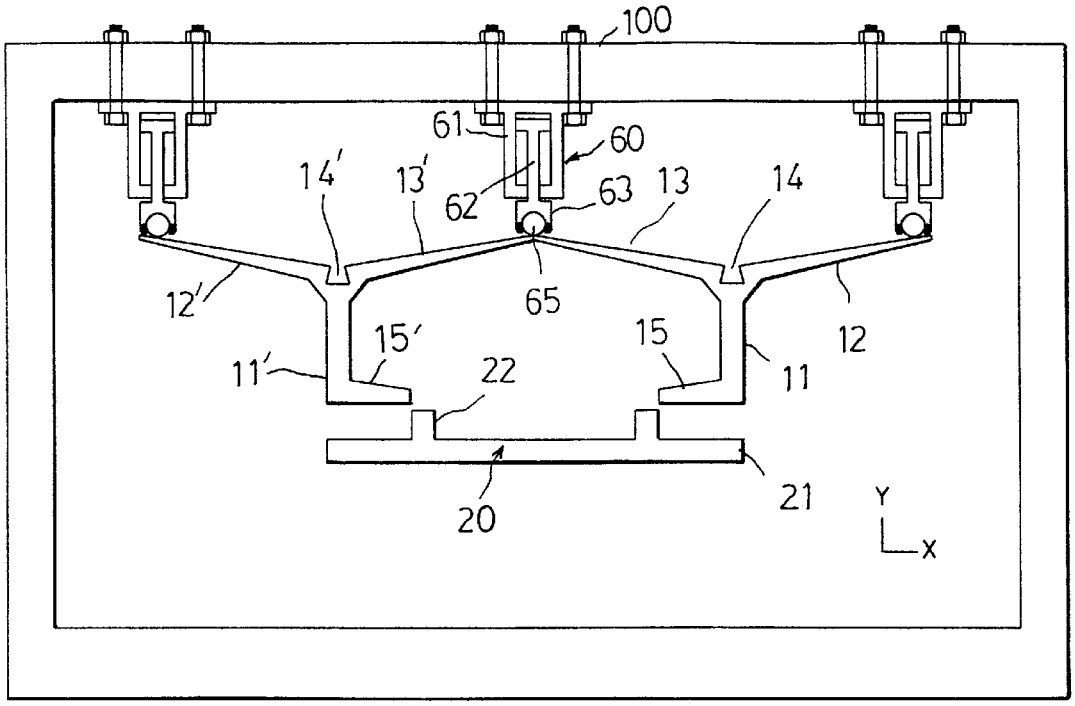
FIGS. 5A to 5D are the sectional views respectively taken from lines 4—4, 4A—4A, 4'—4' and 4A'—4A' of FIG. 4 and 4A illustrating the process of making a multi-axis prestressed double-tee beam of the present invention.
Figure 6:
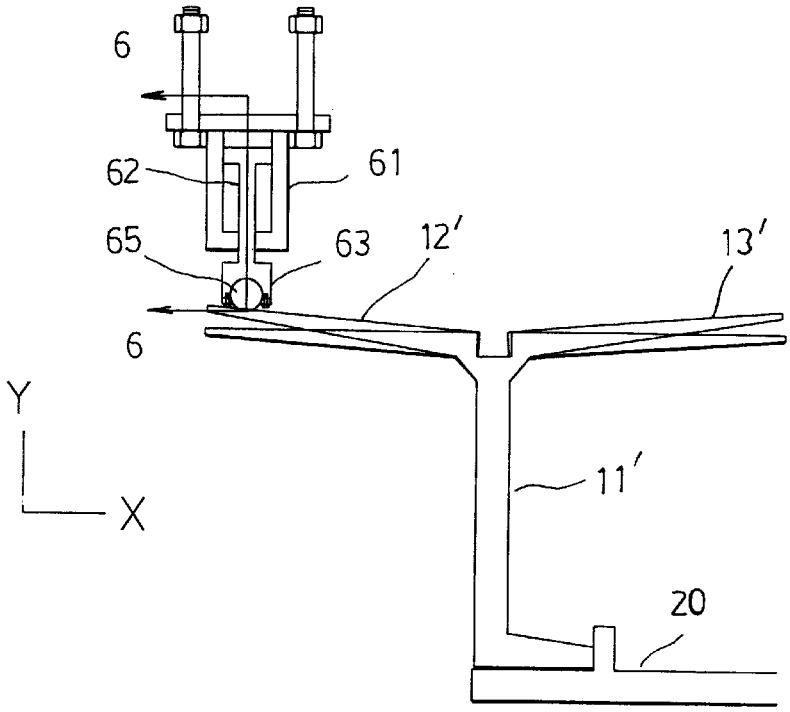
Figure 6A:
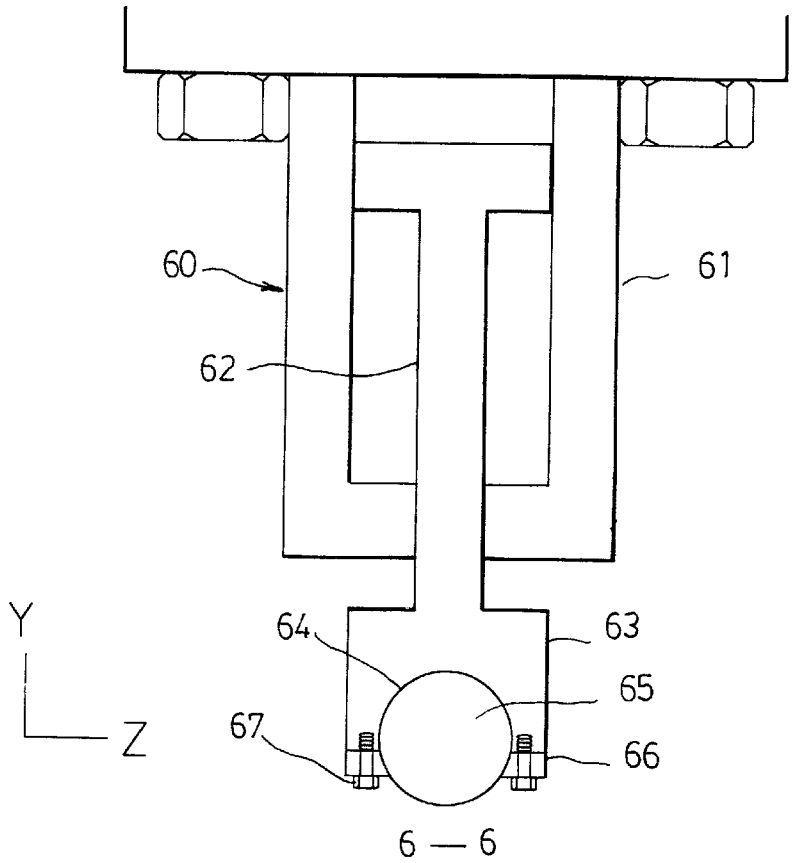

The third step is to engage a plurality of rows of hydraulic presses 60 on the upper flanges 12, 12' and 13, 13' at predetermined intervals (as shown FIG. 4) and each row contains. Three hydraulic presses 60 in a transverse alignment relative to the longitudinal orientation of the skeleton (as shown in FIG. 5A). The hydraulic presses 60 are previously secured to the upper portion of a plurality of steel frames 100 which are fixed to the working side surrounding the working pieces. Each of the frames 100 contains three hydraulic presses 60 fixed spaced apart at equal distances so that the one at center aims to coupling point of the upper flanges 13 and 13' and the other two of them are respectively aiming at the border of the flanges 12 and 12'. Referring to FIGS. 6 and 6A, the hydraulic presses 60 each includes a cylinder 61 and a plunger 62 slidably engaged into the cylinder which has a rectangular pressing head 63 having a hemispherical cavity 64 centrally formed in forward end movably engageable within a pressing ball 65 which is secured by a recessed plate 66 and fastened by screws 67. The hydraulic pressure is supplied by an ambient hydraulic source (not shown).

Figure 5B:
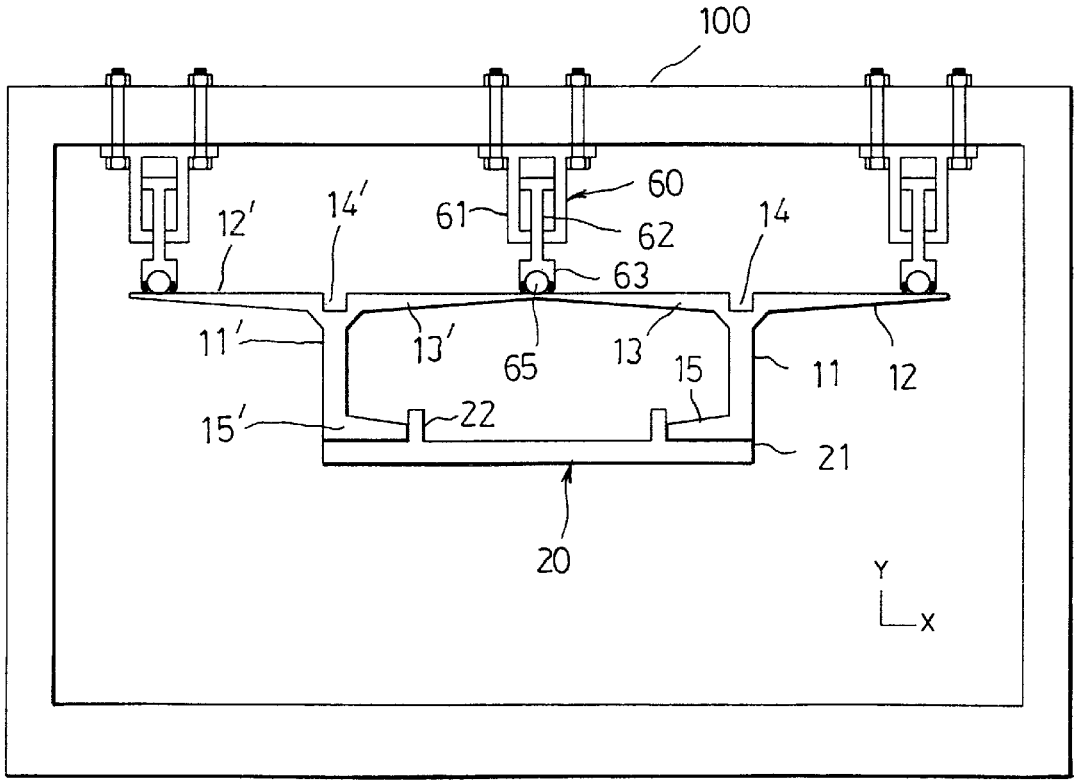
Figure 5C:
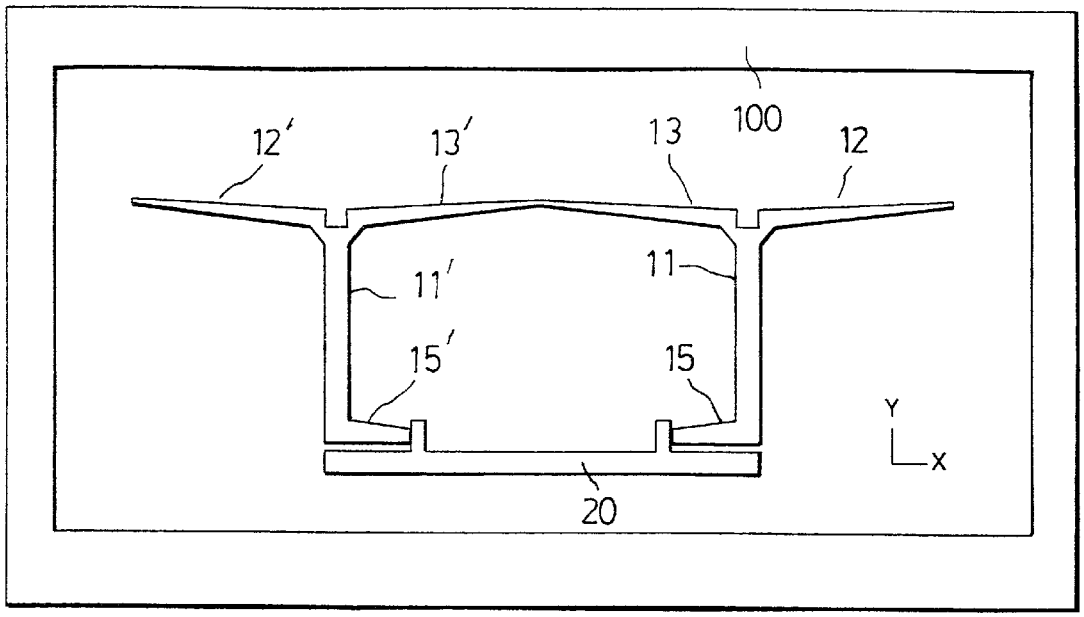

The fourth step is to operate the hydraulic presses with appropriate downward pressure on the flanges 12, 12' and 13, 13' until the W-shaped section of the flanges becoming straightened and the top of the bottom 20 completely engaging with the underside of the lower flanges 15 and 15' (as shown in FIG. 5B). This time, the elongate groove 14 and 14' are widened becoming into a rectangular section that enables to insert the wedges 40 on pair by pair basis. Each pair of the wedges includes a first and second wedges means 40*a* and 40*b* and each of the wedge means 40*a* and 40*b* has a camming surface facing each other. So that each pair of the wedges 40 can be combinable into a rectangular configuration suitable to be received into the widened grooves 14 and 14', when the wedges are received, it will be secured by welding means in order to resist or obviate partially the concentrical stress of the flanges 12, 12' and 13, 13' after the removal of the hydraulic presses 60.

Figure 4A:
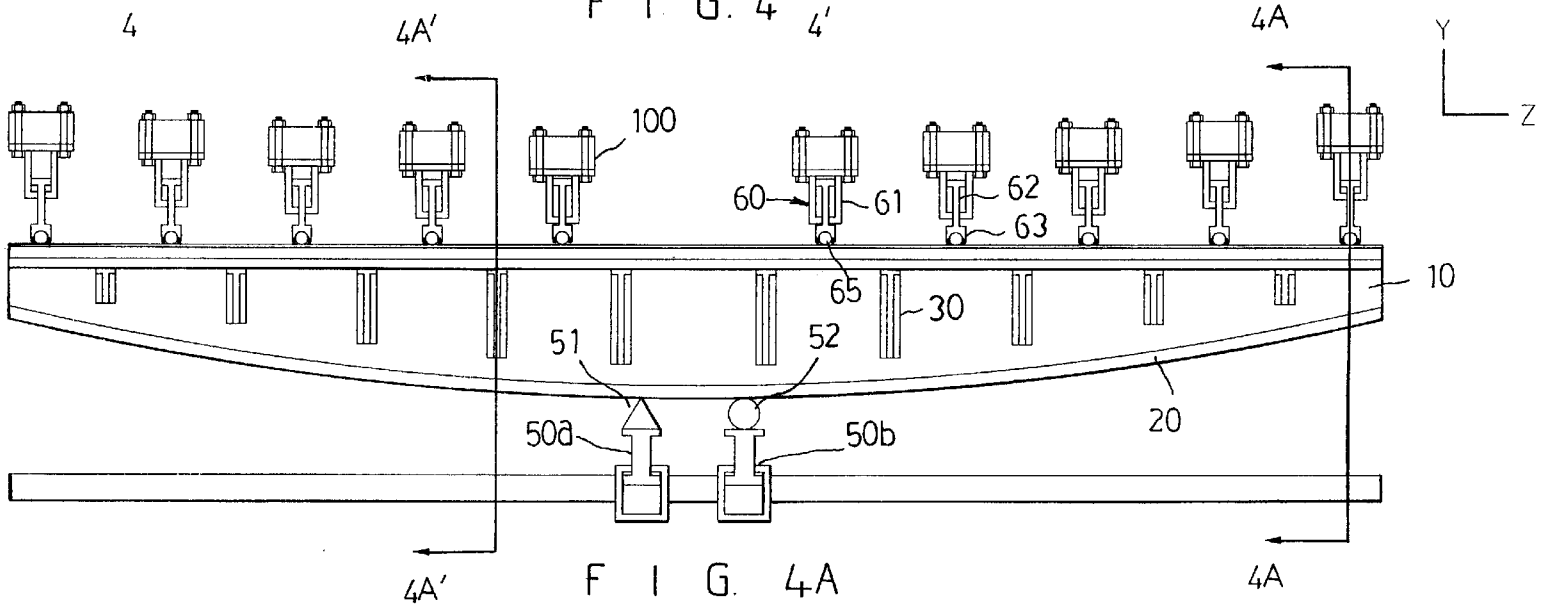
Figure 5D:
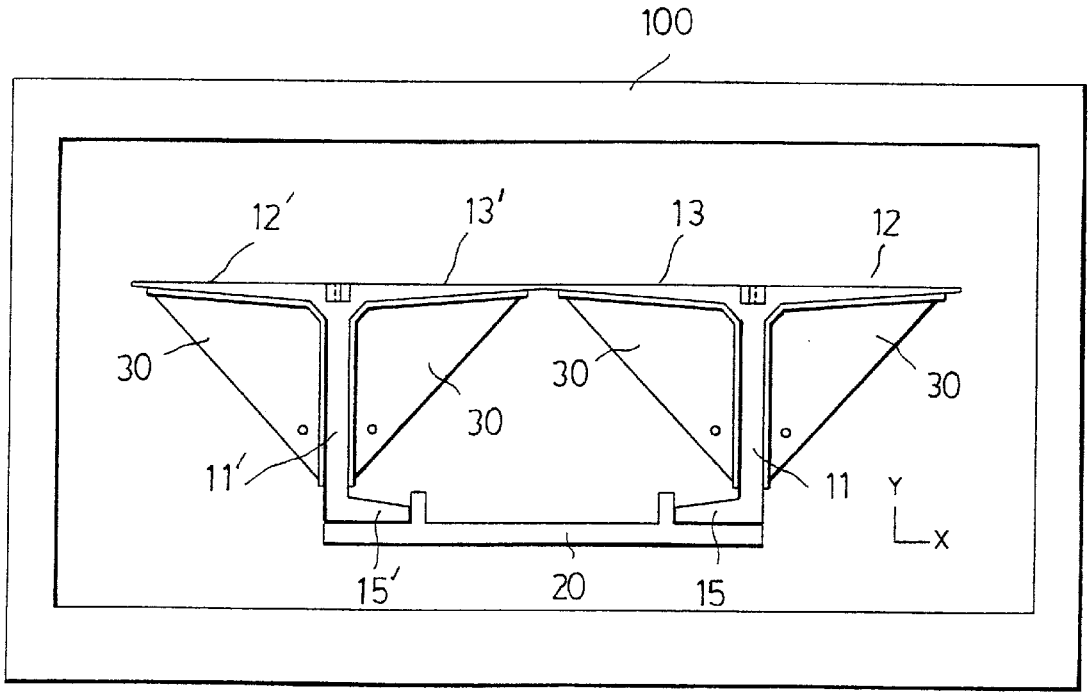

The fifth step is to weld or rivet the steel bottom 20 and the right-angled triangular steel reinforcements 30 on the double-tee steel skeleton 10 and 10' respectively. The triangular reinforcements 30 are arranged into a predetermined number of rows and at predetermined intervals. The largest ones of them are positioned at the middle of the skeleton 10 and 10' and then reduced progressively so that the outmost ones of them are the smallest (as shown in FIG. 4A). Each row contains four pieces of equal sized triangular reinforcements 30 which are symmetrically secured on the opposite sides of the erect webs 11 and 11' and abutted the underside of the straightened upper flanges 12, 13, 13' and 12' (as shown in FIG. 5D).

When the hydraulic presses 60 are removed from the steel skeleton 10 and 10' a multi-axis prestressed double-tee cantilever beam is therefore finished. The beam contains longitudinal upward resilient forces which are constrained by the bottom 20, transverse upward resilient forces which are constrained by the plurality of the triangular reinforcements 30 and the concentrical stresses which are constrained by the wedges 40. Thus, if this cantilever beam is adapted to build a bridge, it will more effectively improve the load capability of the bridge, obviate the slab of the bridge on load from downward deflection and elongate the span of the bridge as well as the spaces between the adjacent beams.

Figures 7, 7A, 7B:
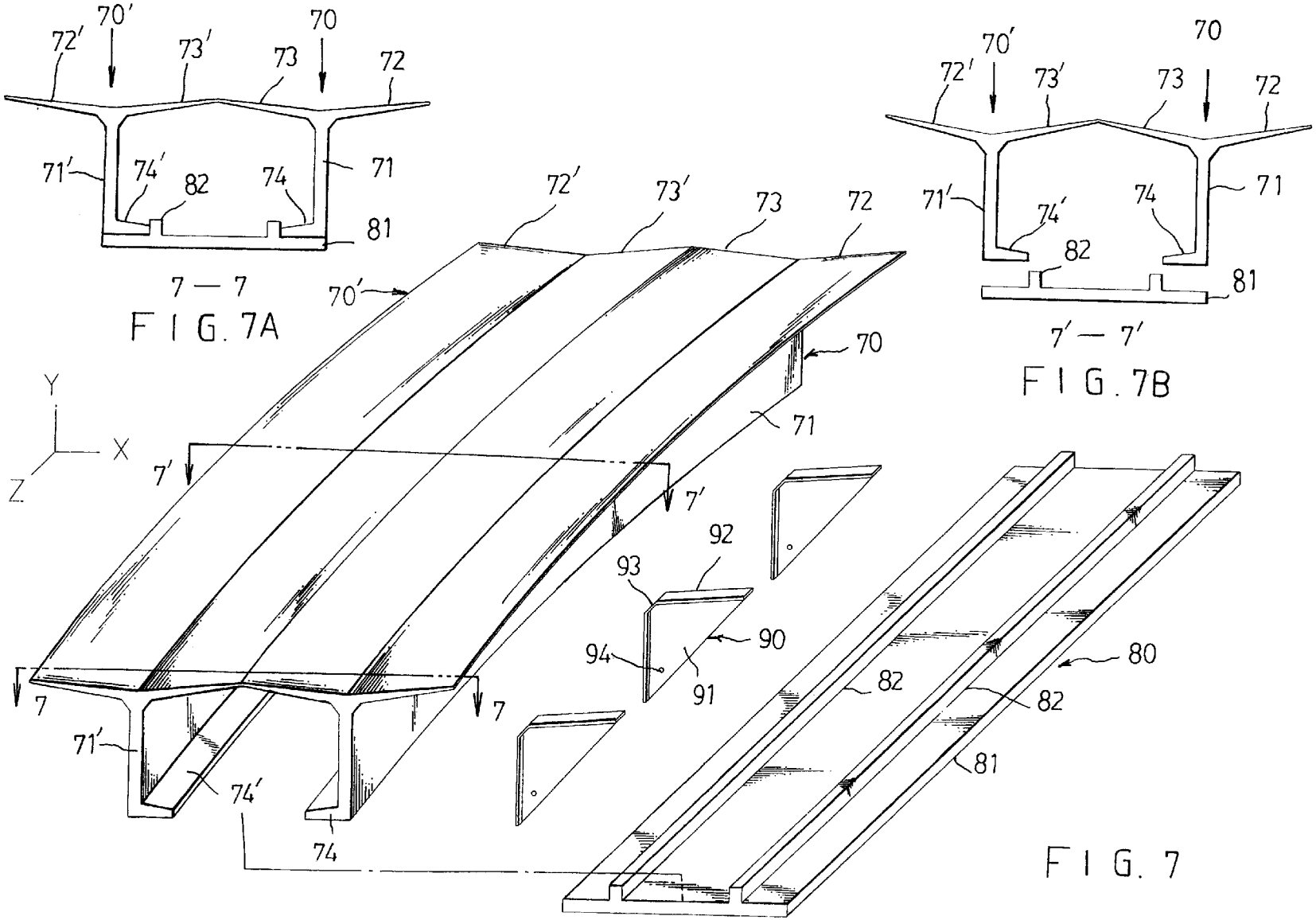
FIG. 7 is an exploded perspective view to show an alternative embodiment of a coupled steel skeleton of a simple-support type prestressed beam according to the present invention.
FIGS. 7A and 7B are the sectional views taken from lines 7—7 and 7'—7' of FIG. 7, FIGS. 8 and 8A are the elevational views indicating the operation of the hydraulic presses upon the upper flanges of the steel skeleton of the simple-support type prestressed beam.
Figure 8:
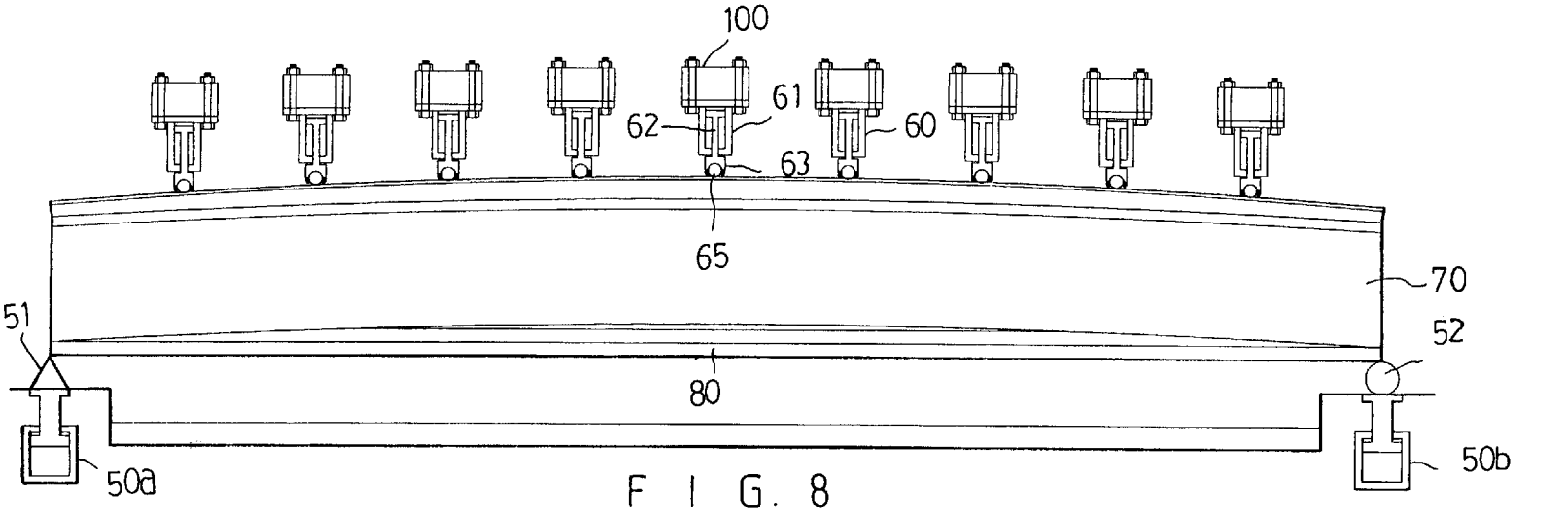

Referring to FIGS. 7, 7A and 7B, an alternative embodiment of the present invention is shown. This embodiment describes the construction of a double-tee simple-support prestressed beam which comprises a laterally connected first and second steel skeletons 70 and 70', a bottom 80 and a plurality of right-angled triangular reinforcements 90 only. The steel skeletons 70 and 70' each includes a generally rectangular erect web 71 and 71' of slightly upward arcuate cross-section (as shown in FIG. 8), a pair of upward sloped first and second upper flanges 72 and 73 or 72' and 73' laterally and obliquely extended outward from the erect web 71 and 71' at predetermined inclinations relative to the horizontal plane with the inclination at middle portion greater than that at two ends thereof (as shown in FIGS. 7A and 7B), and a single sloped surfaced lower flange 74 and 74' laterally extended inward from the lower end of the erect web 71 and toward each other. Since the first steel skeleton 70 is symmetrically connected with the second steel skeleton 70' along their upper flanges 73 and 73', so that the upper flanges 72, 73, 73' and 72' form a roughly W-shaped section (as shown in FIGS. 7A and 7B).

The bottom 80 includes generally a flat rectangular steel plate 81 having a length equal to that of the skeletons 70 and 70' and a width equal to the distance between the outer surfaces of the erect webs 71 and 71', and a pair of longitudinal protrusions 82 parallel extended on the upper surface and along the length thereof. The distance between the outward lateral sides of the longitudinal protrusions 82 equals to the distance between the free ends of the lower flanges 74 and 74', so that when the bottom mounts to the combined first and second steel skeleton 70 and 70', the pair of the longitudinal protrusion 82 closely abut the free ends of the lower flanges 74 and 74' (as shown in FIG. 7A).

The plurality of triangular reinforcements 90 are of equal sized and each includes a right-angled triangular steel piece 91 having on opposite sides of the right-angled triangle reinforced with a rectangular rib 92 which has a frustum 93 made in registry with the sloped portion between the upper flanges 72, 73, 73' and 72' and the erect webs 71 and 71', and a connection hole 94 adjacent a lower angle.

Figure 8A:
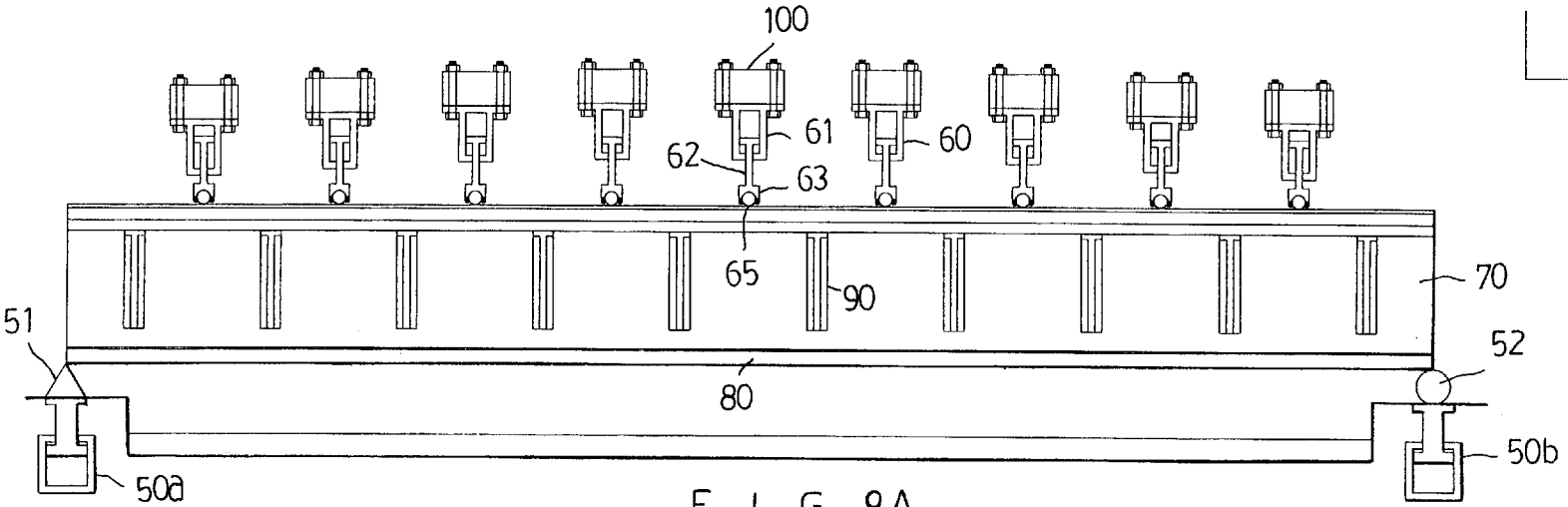

Referring FIGS. 8 and 8A, the operational process of construction of a simple-support double-tee prestressed steel beam is mostly similar to that as showing in FIGS. 4 to 6A and the aforediscussions are applicable in the most instances.

The only difference is that the bottom 80 is supported by the first and second hydraulic supports 50*a* and 50*b* at two ends of the bottom 80 and the plurality of rows of the hydraulic presses are arranged on the upper flanges 72, 73, 73' and 72' at equal intervals. When the upper flanges 72, 73, 73' and 72' become flat relative to the horizontal plane and the upward arcuate erect webs 71 and 71' become straightened under downward pressures of the hydraulic presses 60, the bottom 80 is completely engaged with the lower ends of the erect webs 71 and 71' and the plurality of triangular reinforcements 90 are averagely arranged on four by four basis at the positions between the upper flanges 72, 73, 73' and 72' and the two sides of the erect webs 71 and 71' (as shown in FIG. 8A). Then both the bottom 80 and the triangular reinforcements 90 are secured by welding or riveting means. When the hydraulic presses are released, a simple support double-tee prestressed beam of the present invention is therefore finished. This beam contains central upward resilient force along longitudinal direction which is constrained by the steel bottom 80 and the upper flanges contain upward resilient forces along transverse direction which are constrained by the plurality of the triangular reinforcements 90. Further, both the cantilever or the simple-support prestressed beam can be applied with cement mortar for rust-proof before adapted to build a bridge and the piers of the bridge will support two ends of the simple-support prestressed beam at the positions as it was supported by the first and second hydraulic supports 50*a* and 50*b* which can be adjustable to supplement the hydraulic presses 60 when their downward pressures are likely uneven or inadequate.

Figure 9:
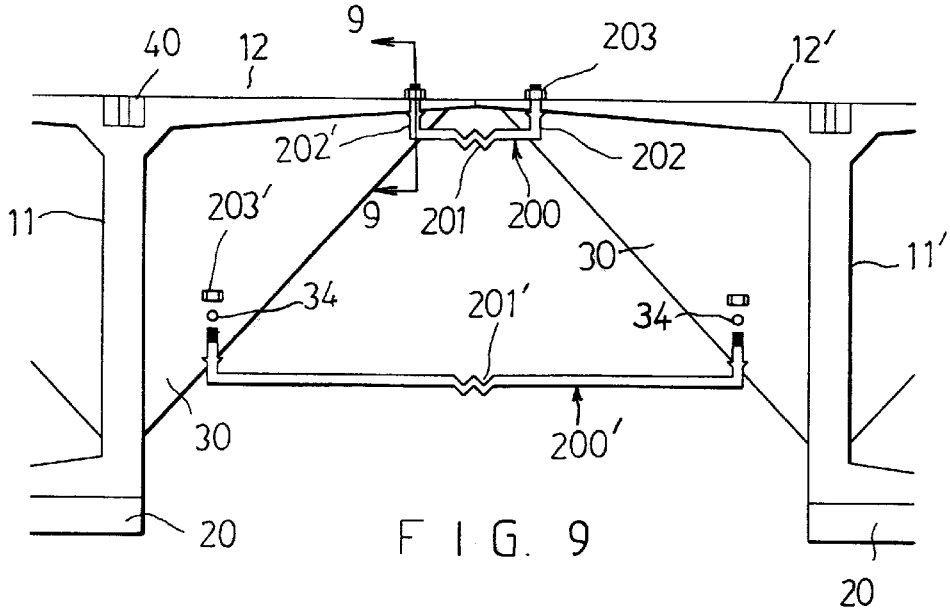
FIG. 9 is an elevational view illustrating the application of a pair of first and second stretching links to connected a pair of adjacent prestressed beams of the present invention.
Figure 9A:
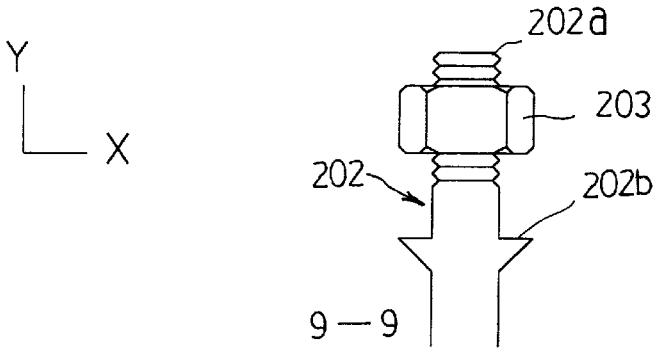
FIG. 9A is a section taken from line 9—9 of FIG. 9.

Referring to FIGS. 9 and 9A, a small and a large U-shaped links 200 and 200' are adaptable to connect a pair of juxtaposed multi-axis prestressed double-tee beams of the present invention on a bridge. The beam may be cantilever type or simple-support type. However, in FIG. 9, a pair of cantilever type prestressed beams are taken for instance. The U-shaped links 200 and 200' each includes a spring means 201 and 201' at a middle of the transverse portion, a threaded end 202*a* and a catch pawl 202*b* on each of the two lateral portions 202 and 202' of the U-shaped (as shown in FIG. 9A). The small U-shaped link 200 vertically connects a pair of the upper flanges 12 and 12' from adjacent cantilever type prestressed beams 10 and 10' through a pair of connection holes in the flanges 12 and 12' and fastened by nuts 203, whereas the large U-shaped link 200' horizontally connects a pair of triangular reinforcements 30 from adjacent beams through the connection holes 34 and fastened by nuts 203'. This way of connection of the prestressed beams provides greater elasticity to a bridge on shock-proof.

Figure 10:
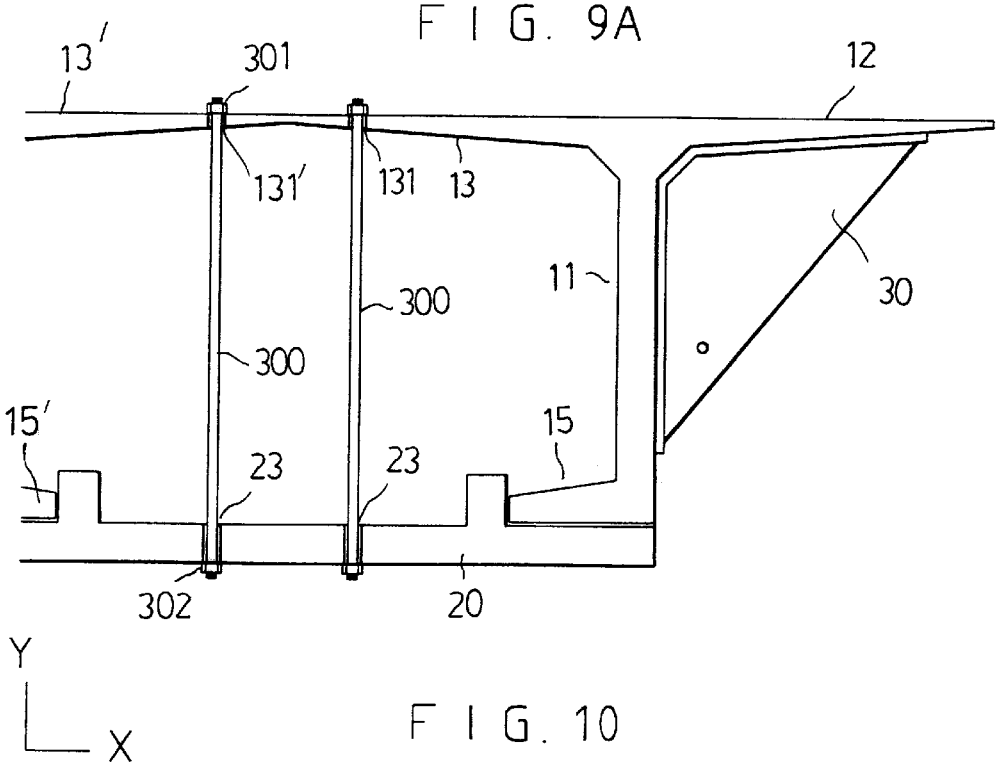
FIG. 10 is an elevational view illustrating a finished structure of a multi-axis prestressed double-tee beam of the present invention, in which a pair of connection poles are adaptable instead of the triangular reinforcements to constrain the upper flanges to the bottom.

Referring FIG. 10. If the prestressed double-tee beam is relatively small and a small space between the erect webs 11 and 11' is inaccessible to secure the triangular reinforcements 30, a pair of connection poles 300 can be adaptable to constrain the inner upper flanges 13 and 13' instead of the triangular reinforcements 30. The connection pole 300 is of a predetermined length and has thread 301 at two ends. Whereas, the connection holes 23, 131 and 131' were previously pierced both in the bottom 20 and upper flanges 13 and 13'. So that once the upper flanges 13 and 13' are pressed to become straightened, the connection poles 300 are inserted through the respective connection holes 23, 131 and 131' and fastened immediately by nuts 302.

Note that the specification relating to the above embodiments should be construed as exemplary rather than as limitation of the present invention, with many variations and modifications being readily attainable by a person of average skill in the art without departing from the spirit or scope thereof as defined by the appended claims and their legal equivalents.

I claim:

1. A multi-axis prestressed double-tee beam comprising:

a pair of symmetrically combined first and second steel skeleton of identical shape and size for constructing a double-tee cantilever prestressed beam, said first and second steel skeletons each comprising a flat elongate erect web having a straight upper edge, a bowed lower edge, an inner surface, an outer surface and a pair of first and second upper flanges laterally extending from along the length of the straight upper edge and transversely sloped upward in a predetermined inclination wherein the inclination at two ends of the flange is greater than that at a middle portion thereof, an elongate groove of roughly U-shaped section centrally extending in the top of the erect web along the length thereof and between the upper flanges and a single lower flange which is narrower than the upper flanges laterally extending inward from along the length of the bowed edge, each lower flange including a sloped upper surface, a flat underside, and a free end so that the upper flanges of said combined steel skeletons form a roughly W-shaped section and the single lower flanges thereof are facing each other;

a bottom including a arcuate rectangular plate having a length comparable to and engaged with the bowed lower edge of the erect web and a width equal to the distance between the outer surface of the erect webs of said combined steel skeletons, and a pair of longitudinal protrusions parallel extending on central upper surface along the length thereof, said longitudinal protrusions each having an outward lateral surface engageable with the free end of each of the single lower flanges of said combined steel skeletons respectively;

a plurality of triangular reinforcements of different size comparable to and spacedly engaged with the triangular spaces defined between each of the erect webs and the upper flanges after that the upper flanges become straightened, said triangular reinforcements each including a right-angled triangular steel piece having a rectangular rib formed along two opposite sides thereof including a frustum portion therebetween and a connection hole adjacent a lower angle;

a plurality of wedge means engaged into the elongate grooves of said combined steel skeletons each having a camming surface facing each other so that each pair of the wedge means can be combined into a rectangular piece.

2. A multi-axis prestressed double-tee beam as recited in claim 1 wherein said reinforcements are arranged into a plurality of rows such that each row contains said four equal sized triangular reinforcements arranged in a transverse alignment relative to the longitudinal orientation of said skeleton wherein the largest sized reinforcements are positioned at a center portion of said skeleton and the size of the reinforcements in other rows from the center to two end of said skeleton are progressively reduced so that the smallest sized reinforcements are positioned at the outmost rows adjacent two ends of said skeletons.

3. A multi-axis prestressed double-tee beam as recited in claim 1 further includes a large and a small U-shaped coupling means adaptable to connect ends of two adjacent beams of said cantilever type, said U-shaped coupling means each including a transverse portion and a pair of lateral portions, a spring means at a middle of the transverse portion, a threaded end and a catch pawl on each of the lateral portions of the U-shaped.

4. A multi-axis prestressed double-tee beam as recited in claim 3 wherein said large U-shaped coupling means connects between two triangular reinforcements of said adjacent beams with the lateral portions of the U-shaped transversly inserting through the connection hole in each of said reinforcements respectively and fastened by a pair of first nuts.

5. A multi-axis prestressed double-tee beam as recited in claim 3 wherein said small U-shaped coupling means connects the upper flanges of said adjacent beams with the lateral portions of the U-shaped vertically inserting through a connection hole of each of said upper flanges respectively and fastened by a pair of second nuts.

6. A multi-axis prestressed double-tee beam as recited in claim 1 further includes a pair of connection poles adaptable of said inner triangular reinforcements to constrain an inner upper flanges of said skeletons, said connection poles each having a cylinder body of predetermined length and threaded ends for vertically inserting through a connection hole in the upper flange and the bottom respectively and secured by fastening means.

7. A multi-axis prestressed double-tee beam as recited in claim 1, wherein said bottom, said reinforcements and said wedge means are connected to said skeletons by means of welding.

8. A multi-axis prestressed double-tee beam comprising:

a pair of symmetrically combined first and second steel skeleton of identical shape and size for constructing a double-tee simple-support prestressed beam, said first and second steel skeletons each comprising a flat rectangular erect web having slightly upward arcuate cross-section, an inner surface, an outer surface, arcuate upper and lower edges, a pair of first and second upper flanges laterally extending from along the length of the arcuate upper edge and transversely sloped upward in a predetermined inclination wherein the inclination at a middle portion greater than that at two end relative to a longitudinal plane thereof, a single lower flange which is narrower than the upper flange laterally extending inward from along the length of the arcuate lower edge including a sloped upper surface, a flat underside and a free end, so that the upper flanges of said combined steel skeletons form a roughly W-shaped section and the single lower flanges thereof are facing each other;

a bottom including a flat rectangular plate having a length comparable to and engaged with the arcuate lower edge of the erect webs and a width equal to the distance between the outer surface of the erect webs of said combined steel skeletons, and a pair of longitudinal protrusions parallel extending on central upper surface along the length thereof, said longitudinal protrusions each having an outward lateral surface engageable with the free end of each of the single lower flanges of said combined steel skeletons respectively;

a plurality of triangular reinforcements of equal size comparable to and spacedly engaged with the triangular spaces defined between each of the erect webs and the upper flanges after that the upper flanges become straightened, said triangular reinforcements each including a right-angled triangular steel piece having a rectangular rib formed along two opposite sides including a frustum portion therebetween and a connection hole adjacent a lower angle.

9. A multi-axis prestresed double-tee beam as recited in claim 8 wherein said reinforcements are arranged into a plurality of rows such that each row contains said four equal sized triangular reinforcements arranged in a transverse alignment relative to the longitudinal orientation of said skeleton wherein two of them toward outward relative to the outer surface of the erect webs and the other two toward inward thereof.

10. A multi-axis prestressed double-tee beam as recited in claim 8 further includes a large and a small U-shaped coupling means adaptable to connect ends of two adjacent beams of said simple-support type, said U-shaped coupling means each including a transverse portion and a pair of lateral portions, a spring means at a middle of the transverse portion, a threaded end and a catch pawl on each of the lateral portions of the U-shaped.

11. A multi-axis prestressed double-tee beam as recited in claim 10 wherein said large U-shaped coupling means connects between two triangular reinforcements of said adjacent beams with the lateral portions of the U-shaped transversly inserting through the connection hole in each of said reinforcements respectively and fastened by a pair of first nuts.

12. A multi-axis prestressed double-tee beam as recited in claim 10 wherein said small U-shaped coupling means connects the upper flanges of said adjacent beams with the lateral portions of the U-shaped vertically inserting through a connection hole of each of said upper flanges respectively and fastened by a pair of second nuts.

13. A multi-axis prestressed double-tee beam as recited in claim 8 further includes a pair of connection poles adaptable instead of a pair said inner triangular reinforcements to constrain an inner upper flanges of said skeleton, said connection poles each having a cylinder body of predetermined length and threaded ends for vertically inserting through a connection hole in the upper flange and the bottom respectively and secured by fastening means.

14. A multi-axis prestressed double-tee beam as recited in claim 8 wherein said bottom and said reinforcements are connected to said skeletons by means of welding.

* * * * *